US007461623B2

(12) United States Patent
Tsubouchi et al.

(10) Patent No.: US 7,461,623 B2
(45) Date of Patent: Dec. 9, 2008

(54) OUTBOARD ENGINE UNIT

(75) Inventors: Masanori Tsubouchi, Wako (JP); Kazuhiro Ishizaka, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 25 days.

(21) Appl. No.: 11/806,339

(22) Filed: May 31, 2007

(65) Prior Publication Data

US 2007/0277766 A1 Dec. 6, 2007

(30) Foreign Application Priority Data

May 31, 2006 (JP) ..... 2006-152304
Aug. 24, 2006 (JP) ..... 2006-228057

(51) Int. Cl.
*F02M 35/10* (2006.01)

(52) U.S. Cl. ..... 123/184.42; 123/184.47

(58) Field of Classification Search ..... 123/184.42, 123/184.47

See application file for complete search history.

(56) References Cited

U.S. PATENT DOCUMENTS 5,832,890 A * 11/1998 Ikeya et al. ..... 123/184.47

FOREIGN PATENT DOCUMENTS

JP 10-184469 A 7/1998

* cited by examiner

*Primary Examiner*—Noah Kamen
(74) *Attorney, Agent, or Firm*—Westerman, Hattori, Daniels & Adrian, LLP.

(57) ABSTRACT

An outboard engine unit has an intake manifold extending in a front-and-rear direction along one side of an engine block and comprised of a surge tank and a plurality of intake tubes communicating with the surge tank. Each of the intake tubes is arranged so as to be separated in a vertical direction. The shape of the channel cross section of each of the intake tubes is a flat shape in which the dimension in the vertical direction is less than the dimension in a crosswise direction.

4 Claims, 15 Drawing Sheets

OUTBOARD ENGINE UNIT

FIELD OF THE INVENTION

The present invention relates to an improved outboard engine unit and, in particular, to an intake manifold of an engine.

BACKGROUND OF THE INVENTION

A conventional intake manifold for preventing a reduction in engine output in an engine provided with a plurality of intake tubes that extend at different slope angles from a surge tank is disclosed in JP 10-184469 A.

The manifold disclosed in JP 10-184469 A has a single surge tank and four vertically arranged intake tubes that are in communication with the surge tank. With an intake manifold disposed on one side of the engine, the slope angles of the intake tubes connected to the four combustion chambers formed in the cylinder head are different. Therefore, to prevent the length of the intake tubes from being nonuniform, the intake tube having the lowest slope angle is disposed so as to extend most greatly to the side, and the intake tube having the highest slope angle is disposed so as to extend by the least amount to the side, thus compensating for the nonuniform lengths of the intake tubes and achieving a substantially fixed intake tube length.

In the above-described intake tubes, each intake tube has the same circular cross-sectional shape.

When the cross-sectional area of the tubes is increased to achieve higher engine output, the spacing between the openings to the cylinders becomes narrow, and sufficient output cannot be achieved because of intake interference when the ignition sequence begins from the intake tube in the highest position and ends with the intake tube in the lowest position.

The dimension in the height of the engine increases when the spacing between cylinders is increased in order avoid intake interference, leading to an increase in the size of the intake manifold composed the intake tubes.

When the intake tubes are given a large cross-sectional area in order to increase engine output, the cross-sectional shapes of the intake tubes are increased in the longitudinal and transverse directions. In other words, in the intake manifold on one side of the cylinder block of an engine, the size of the cross-sectional shape in the height direction of the vertically arranged intake tubes is increased, or the size of the cross-sectional shape of the intake tubes is increased in the width direction from the intake tube in the highest position and to the intake tube in the lowest position.

Therefore, the size of the intake manifold disposed on one side of the engine is increased in the height direction, the degree of freedom in the layout of the equipment disposed in the upper portion of the engine is reduced, the entire height of the engine cover is increased, or the size in the width direction is increased beginning with intake tube in the highest position, and the width of the engine cover is increased from the lower portion to the upper portion. It is therefore impossible to adopt an engine cover in which the upper portion of the cover is made narrow and the cover gradually becomes wider in the downward direction, and other problems are encountered.

In view of the above, there is a need for an outboard engine unit in which the dimension in the height of vertically arranged intake tubes is minimized, the undesirable effects of intake interference between cylinders is reduced, and engine output is improved for an arrangement of intake tubes in the intake manifold of an engine.

SUMMARY OF THE INVENTION

According to an aspect of the present invention, there is provided an outboard engine unit which comprises an engine including an engine block, the engine block being comprised of a cylinder block, a cylinder head disposed in a rear portion of the cylinder block, and a crankcase disposed in a front portion of the cylinder block; an engine cover defining an engine compartment for accommodating the engine; and an intake manifold comprised of a single surge tank and a plurality of intake tubes communicating with the surge tank, wherein the intake manifold extends in a front-and-rear direction along one side of the engine block, each of the intake tubes is arrayed so as to have a space between each other in a vertical direction, and the shape of a channel cross section of each of the intake tubes is a flat shape having a vertical dimension which is less than a dimension in a crosswise direction.

In the outboard engine unit, channels in the intake tubes connected to the surge tank are given a transversely flat cross-sectional shape that is a shorter in the crosswise dimension than in the vertical dimension. The space between the openings of the vertically adjacent intake tubes can therefore be increased, the intake flow of one adjacent opening is less liable to flow to another opening, and mutual interference between adjacent openings of the intake tubes can be prevented. For this reason, the intake pulses of the surge tank can be more effectively used and engine output can be improved. The dimension in the height of the intake tubes can be reduced, the outside dimensions of the outboard engine unit can be made more compact, and sufficient space inside the engine compartment of the outboard engine unit can be more efficiently assured.

According to a second aspect of the present invention, there is provided an outboard engine unit comprising: an engine comprised of a cylinder block, a cylinder head disposed in a rear portion of the cylinder block, and a crankcase disposed in a front portion of the cylinder block; an engine cover defining an engine compartment for accommodating the engine; and an intake manifold comprised of a surge tank and a plurality of intake tubes having upstream portions being in communication with the surge tank, wherein the intake tubes are arrayed in a vertical direction and have downstream portions being in communication with combustion chambers formed in such a manner as to be aligned in a vertical direction in the cylinder head, each of the intake tubes has substantially a same cross-sectional area, and the cross-sectional shape of a channel in a highest one of the intake tubes is long in a longitudinal direction, and the cross-sectional shape of a channel in a lowest one of the intake tubes is long in a transverse direction.

Therefore, the vertically arranged intake tubes have essentially the same cross-sectional area, and the highest intake tube is long in the longitudinal direction. Therefore, the length of the protrusion in the width direction of the highest intake tube at the top of the intake manifold can be minimized. Since the lowest intake tube is long in the transverse direction, the height can be reduced while increasing the distance in the width direction, and the dimension in the height direction of the intake manifold can be reduced while increasing the cross-sectional area of the intake tubes. Therefore, the intake tubes can be effectively disposed along the inner wall of the engine cover in which the top portion is narrow and the lower portion is wide.

It is preferable that each of the intake tubes is provided with an outer long channel portion and a short channel portion near the engine that are arranged in parallel inside the engine compartment, the channel portions merge in a shared channel on a downstream side, the cross-sectional shape of the highest long channel portion selected from the long channel portions is long in the longitudinal direction, and the lowest long channel portion has a cross-sectional shape long in the transverse direction, and each of the short channel portions is provided with an on/off valve that operates simultaneously in the same direction. Thus, the on/off valves disposed in the short intake channels are opened and closed to thereby switch the intake channels from high speed and high load operation to low speed and low load operation in a simple manner.

It is also preferable that the cross-sectional shape of channels in the intake tubes is one in which the highest long channel portion and a shared channel in communication therewith are long in the longitudinal direction, and the lowest long channel portion and the shared channel in communication therewith are long in the transverse direction, and the short channel portions have essentially the same cross-sectional shape. Therefore, the cross-sectional area of the intake tubes including the shared channel can be increased, higher output can be assured, and the on-off valves that open and close the inner short channel portions can be reliably operated.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
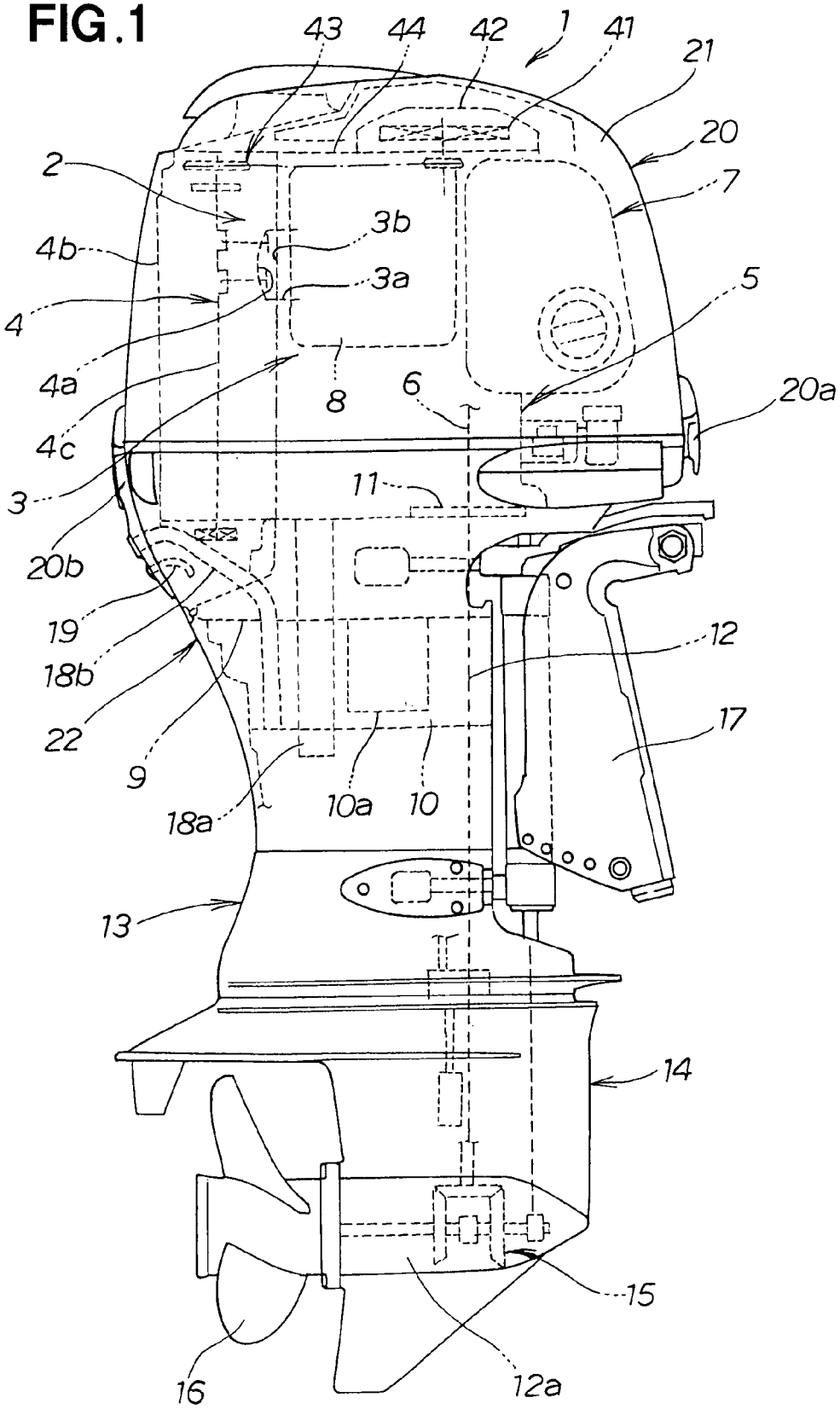
FIG. 1 is a side elevational view illustrating an outboard engine unit employing the present invention.

As shown in FIG. 1, an outboard engine unit 1 has an engine 2 covered by an engine cover 20.

The engine 2 is a multi-cylinder four-stroke engine provided with substantially horizontally (hereinafter referred to as transverse) moving pistons and a vertically disposed crankshaft. The engine 2 is provided with an engine block 2*a* (FIG. 3) composed a cylinder block 3, a cylinder head 4 disposed in a rear portion of the cylinder block 4, and a crankcase 5 disposed in a front portion of the cylinder block 3. The cylinder block 3 has a plurality of cylinders 3*a* and a plurality of pistons 3*b* corresponding to the cylinders 3*a*. The cylinder head 4 has a plurality of combustion chambers 4*a* and is covered by a cylinder head cover 4*b*. The crankcase 5 houses a vertical crankshaft 6.

An intake silencer 7 is disposed from the front portion of the right side of the crankcase 5 across the forward portion. The intake silencer 7 introduces air (outside air) from an intake port.

An electric component 8 is disposed on the right-side surface of the cylinder block 3. The electric component 8 accommodates electronic control devices that control the ignition and fuel injection devices of the engine.

The engine 2 is supported by a mounting case 9. An oil case 10 that houses an oil pan 10*a* is joined to the lower surface of the mounting case 9.

The engine 2 is covered by an engine cover 20. The engine cover 20 is composed of an upper cover 21 that covers the upper portion of the engine 2, and a lower cover 22 that covers the lower portion of the engine 2. The engine compartment A (FIG. 3) that houses the engine 2 is partitioned by the upper and lower covers 21 and 22. The upper cover 21 can be opened with respect to the lower cover by operating lock mechanisms 20*a* and 20*b* disposed on the front and rear of the outboard engine unit 1 so that the engine 2 can be serviced and repaired.

A vertical crankshaft 6 is provided with a flywheel 11 at the lower end of the crankshaft and is connected to a downwardly suspended drive shaft 12. The drive shaft 12 passes through the inside of an extension case 13 disposed below the bottom cover 22, and is connected to a gear transmission mechanism 15 accommodated in a gear case 14 mounted on the lower end of the extension case 13.

The gear transmission mechanism 15 transmits the drive force of the drive shaft 12 to a horizontal driven shaft 12*a*. The rear end portion of the horizontal driven shaft 12*a* protrudes rearward from the gear case 14. A propeller 16 is mounted on the rear end portion of the horizontal driven shaft 12*a*. The propeller 16 is driven by the motive force of the engine 2. The outboard engine unit 1 produces forward or rearward propulsion by switching the direction of the propeller 16 with the aid of a pair of dog clutches.

The outboard engine unit 1 is detachably mounted on the stern by way of a stern bracket 17.

In the diagrams, reference numeral 18*a* indicates a main exhaust tube. A portion of the exhaust is exhausted rearward from the engine cover 20 by way of a sub-exhaust pipe 18*b*. A water test port 19 discharges a portion of the cooling water in the rearward direction of the lower cover 22 in order to visually confirm whether cooling water is flowing to the engine cooling unit.

A power generator 41 is disposed on the upper end portion of the crankshaft 6 that protrudes above the upper surface of the cylinder block 3. The power generator 41 is covered by a power generator cover 42. A chain drive mechanism 43 is provided with a valve-operating chain suspended across a drive sprocket mounted at the upper end of the crankshaft 6, and a driven sprocket mounted at the upper end of a camshaft 4*c*. The chain drive mechanism 43 is covered by a chain cover 44.

Figure 2:
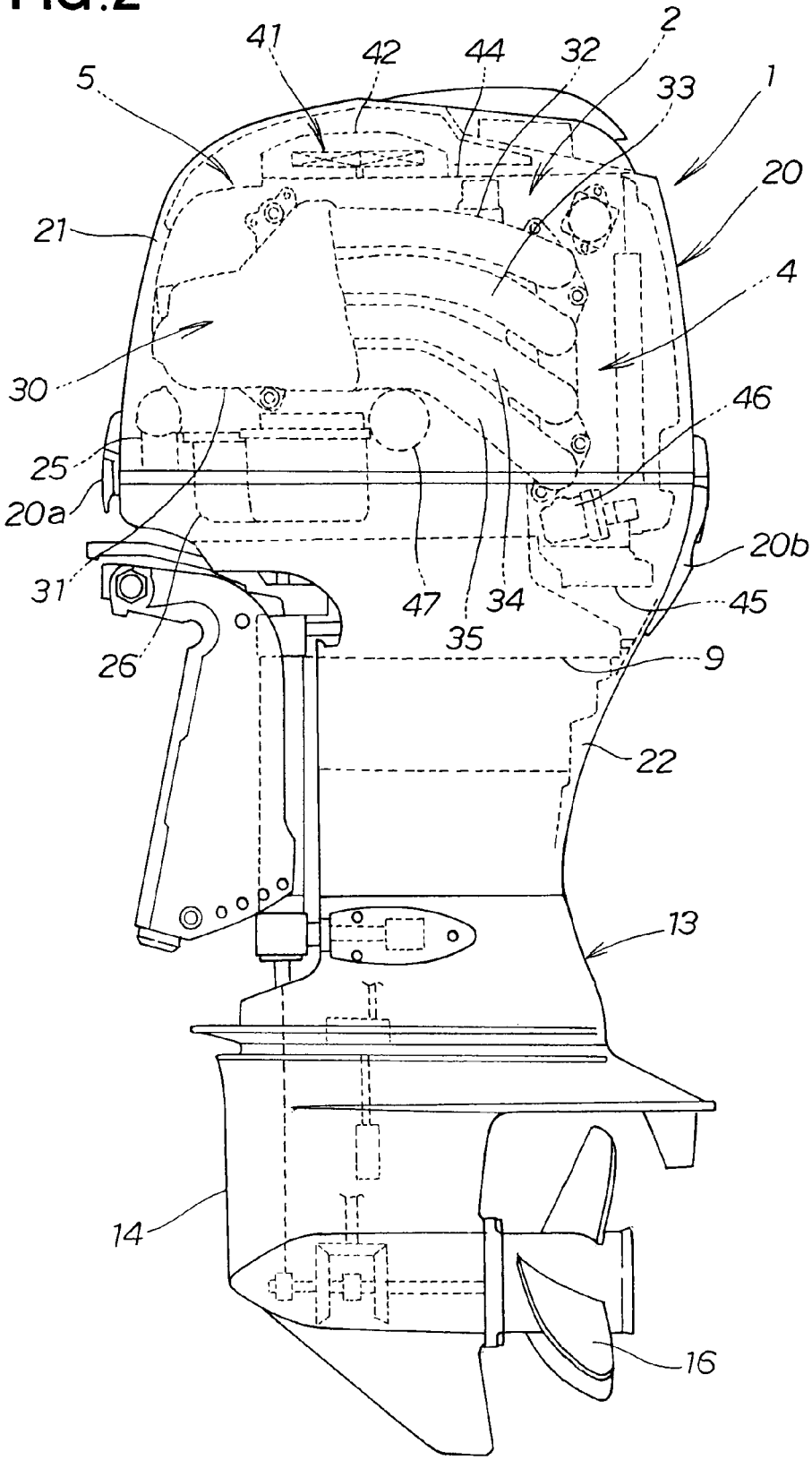
FIG. 2 is a rear elevational view of the outboard engine unit of FIG. 1, with an intake manifold, according to a first embodiment of the present invention, shown by dotted line.
Figure 3:
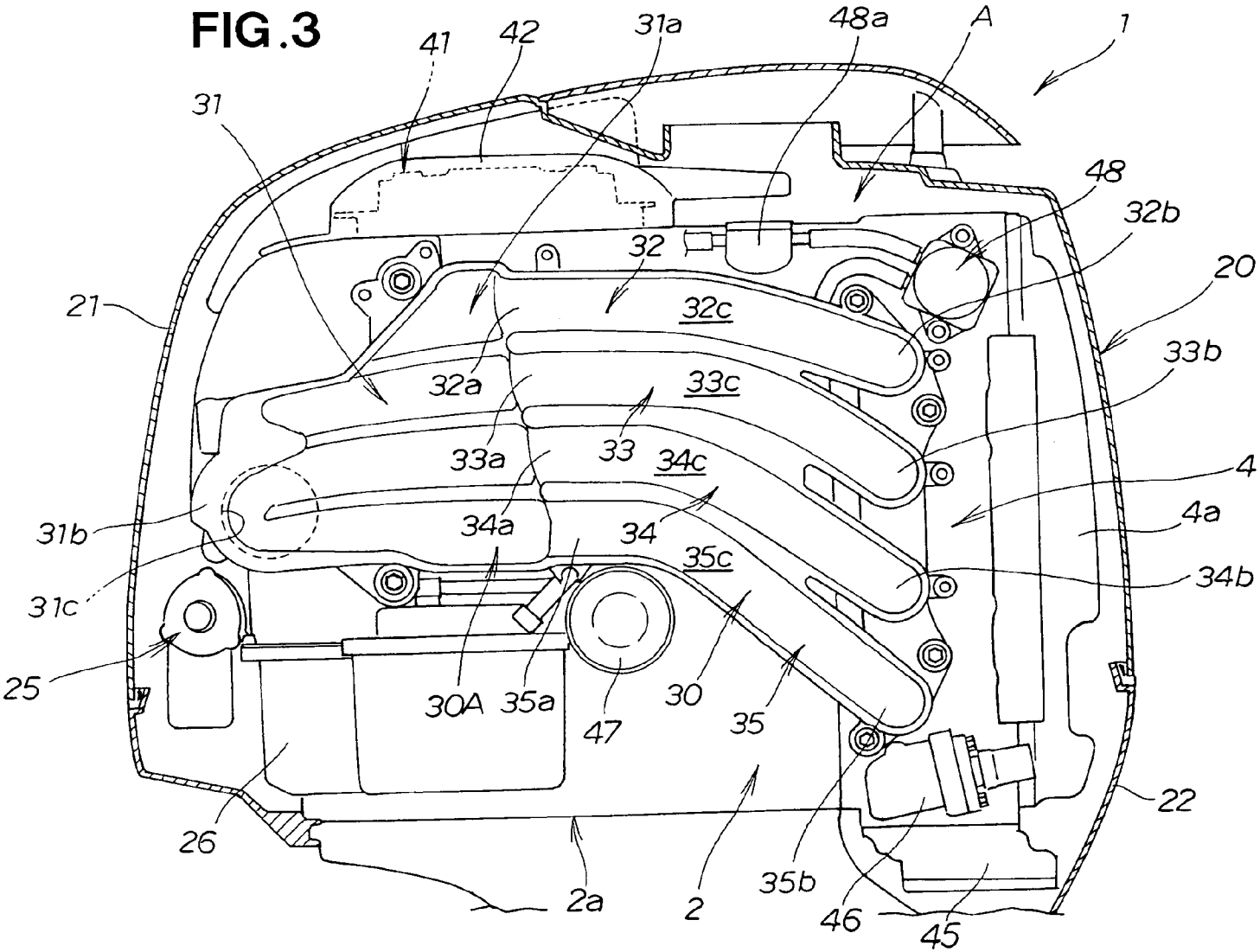
FIG. 3 is an enlarged view showing the intake manifold with an engine cover of FIG. 2 removed.
Figure 8:
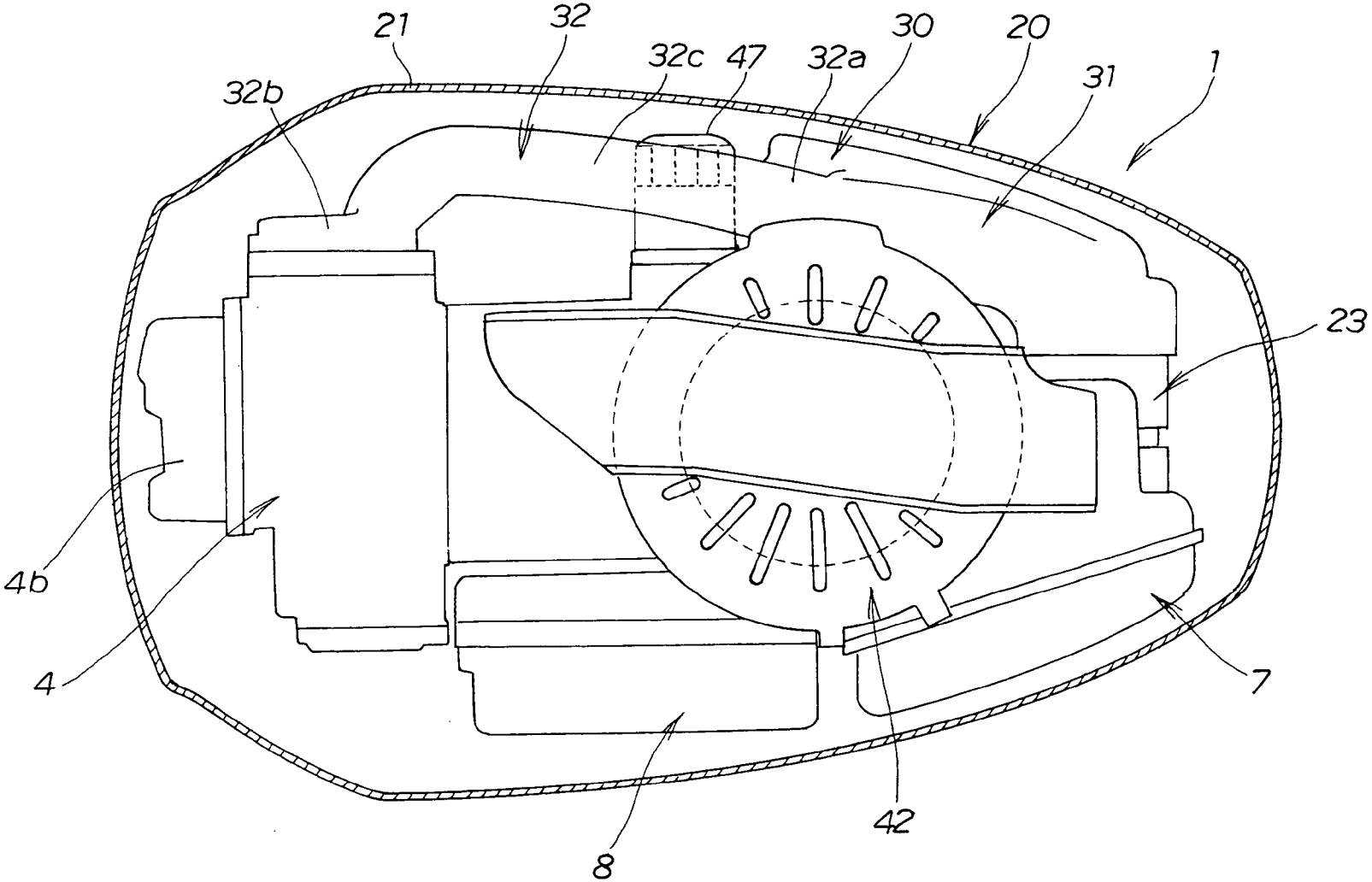
FIG. 8 is a top plan view showing the outboard engine unit with an upper cover removed.

An intake manifold 30 is disposed on the left side surface of the engine 2, as shown in FIGS. 2, 3, and 8. The intake manifold 30 is composed of a large-capacity surge tank 31 (FIG. 8) facing the intake silencer 7 side, and a plurality of intake tubes 32, 33, 34, and 35 that branches off from a downstream portion 31*a* (FIG. 3) of the surge tank 31. In this embodiment, there are four intake tubes 32, 33, 34, and 35 because the engine 2 has four cylinders aligned in the vertical direction. The four intake tubes 32, 33, 34, and 35 are in communication with the surge tank 31.

The four intake tubes 32, 33, 34, and 35 branch off from the downstream portion 31*a* of the surge tank 31, as shown in FIG. 3, and are composed of base end portions 32*a*, 33*a*, 34*a*, and 35*a* that are in communication with the surge tank 31, distal end portions 32*b*, 33*b*, 34*b*, and 35*b* having openings 32*d*, 33*d*, 34*d*, and 35*d* (FIG.5) connected to the intake ports of the combustion chambers 4*a* of the cylinder head 4, and intermediate portions 32*c*, 33*c*, 34*c*, and 35*c* positioned between the base end portions 32*a*, 33*a*, 34*a*, and 35*a* and the distal end portions 32*b*, 33*b*, 34*b*, and 35*b*.

Four intake ports of the cylinder head 4 are disposed in the vertical direction, and the highest intermediate portion (first intermediate portion) 32*c* and the lower intermediate portions 33*c*, 34*c*, and 35*c* are sequentially curved downward. The upper intermediate portions are extended further outward than the lower intermediate portions. The lengths of the intake tubes 32, 33, 34, and 35 are set so as to be equal.

Figure 6:
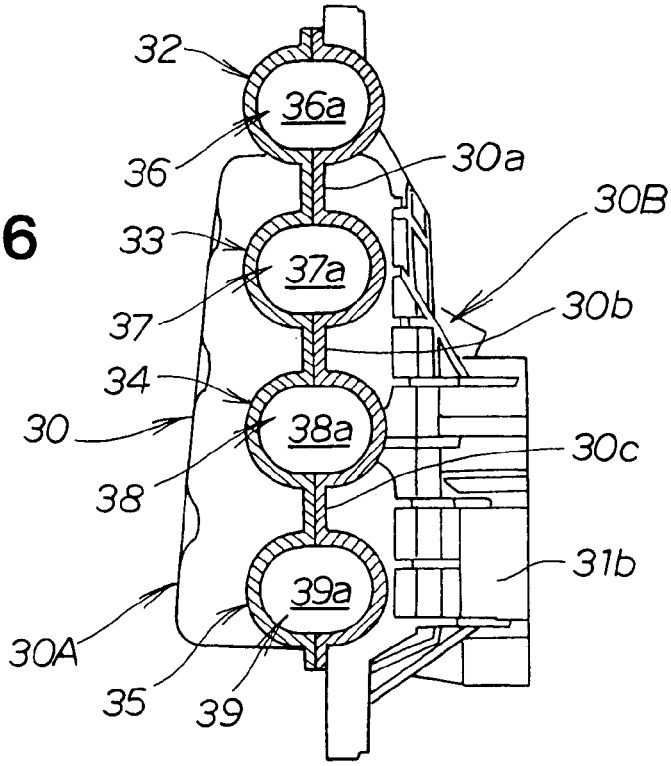
FIG. 6 is a cross-sectional view taken along line 6-6 of FIG. 4.

The intake manifold 30 has a structure in which two members, i.e., an outer member 30A positioned on the outside and an inner member 30B positioned on the inside, are superimposed with each other, as shown in FIG. 6.

Figure 5:
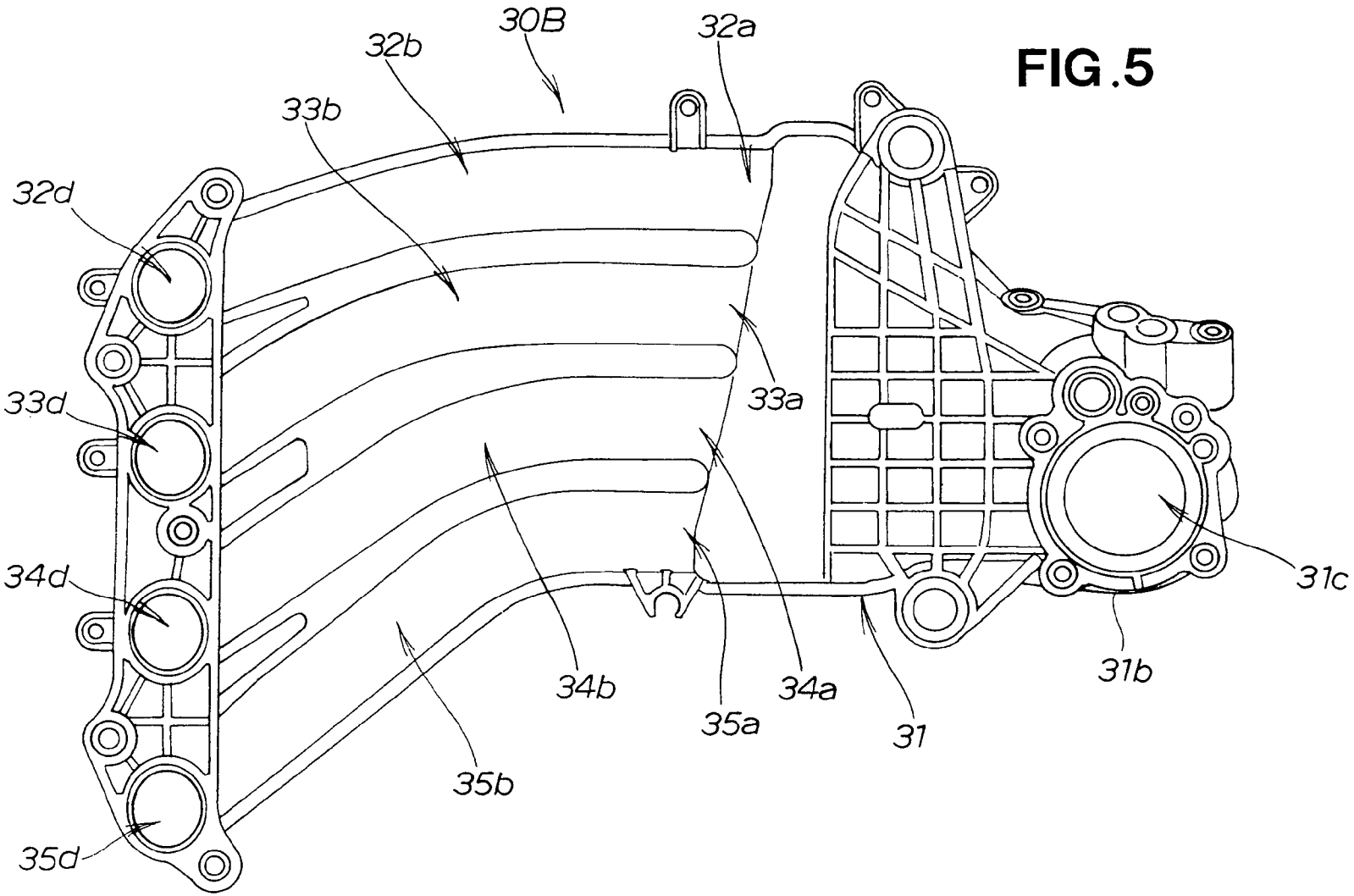
FIG. 5 is a view showing the intake manifold with components disposed internally thereof.
Figure 9:
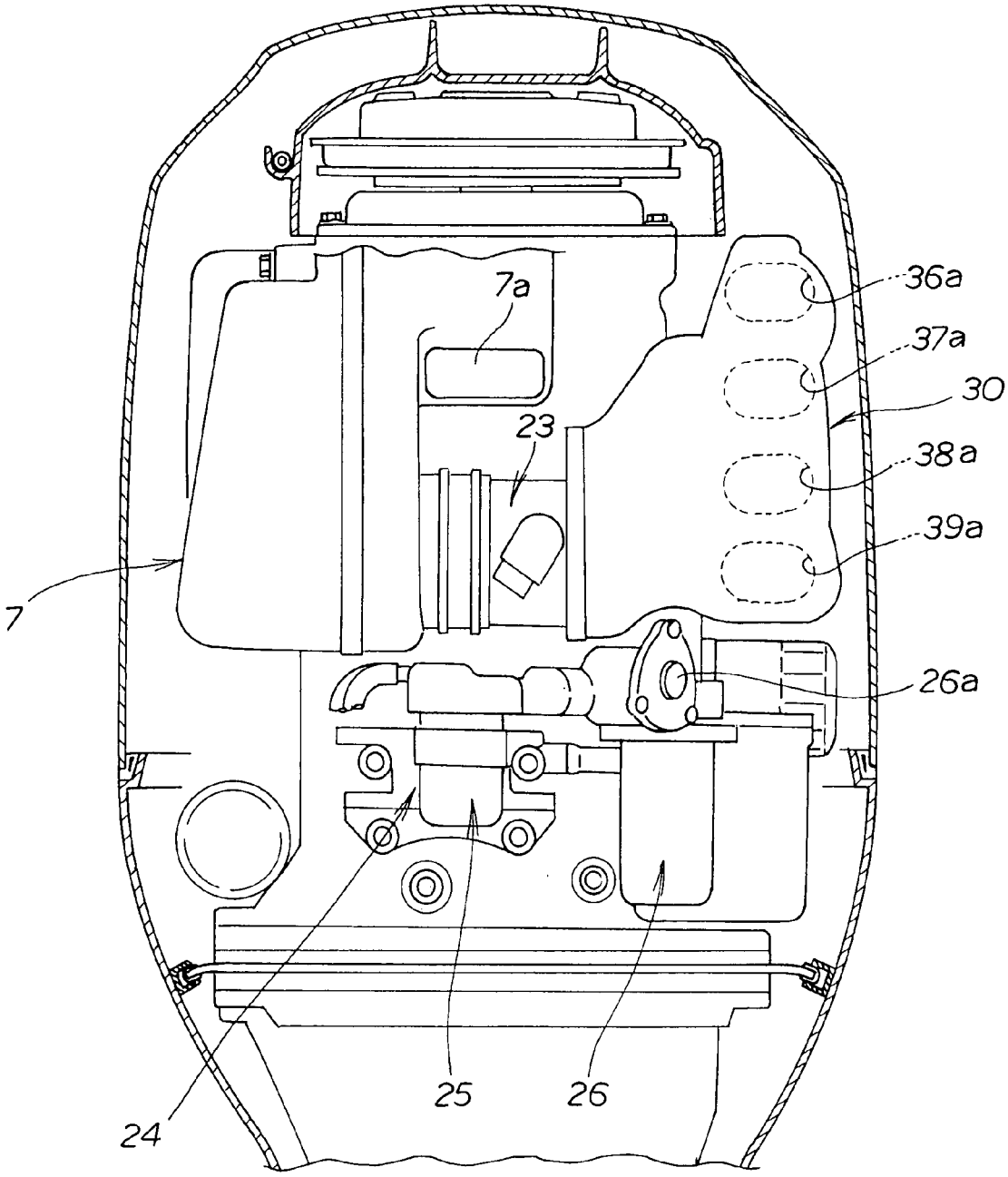
FIG. 9 is a front elevational view of the outboard engine unit with the engine cover partially removed.

As shown in FIG. 5, the upstream portion 31*b* of the surge tank 31 of the inner member 30B has an intake port 31*c* that is in communication with a throttle valve device 23 connected to the intake silencer 7 shown in FIGS. 8 and 9. Air (outside air) is introduced from the intake port 31*c* into the intake manifold 30.

The intake silencer 7 is positioned on the right side of the engine 2 (FIG. 1), and the intake manifold 30 is positioned on the left side of the engine 2, as shown in FIGS. 8 and 9. The intake silencer 7 and intake manifold 30 are connected by way of the throttle valve device 23 positioned in front of the engine 2.

The reference numeral 24 in FIG. 9 is an electrical component composed of a relay switch. The reference numeral 25 is a fuel/water separator, 26 is a high pressure fuel pump, and 26*a* is a high pressure fuel pump filter. The intake silencer 7 has an intake port 7*a* for taking in air.

An oil pump 45 is disposed at the lower end of the cylinder head 4, as shown in FIG. 3. A valve-switching device 46 is disposed below the distal end portion 35*b* of the lowest intake tube 35 of the intake manifold 30. The valve-switching device 46 switches the intake valves and the exhaust valves between low-speed operation and the high-speed operation positions. An oil filter 47 is disposed below the intermediate portion 35*c* of the lowest intake tube 35. In the diagram, the reference numeral 48 is a fuel pump and 48*a* is a fuel filter.

Channels 36, 37, 38, and 39 formed inside the intake tubes 32, 33, 34, and 35 of the intake manifold 30 are configured in the manner described below, as shown in FIG. 6.

Figure 4:
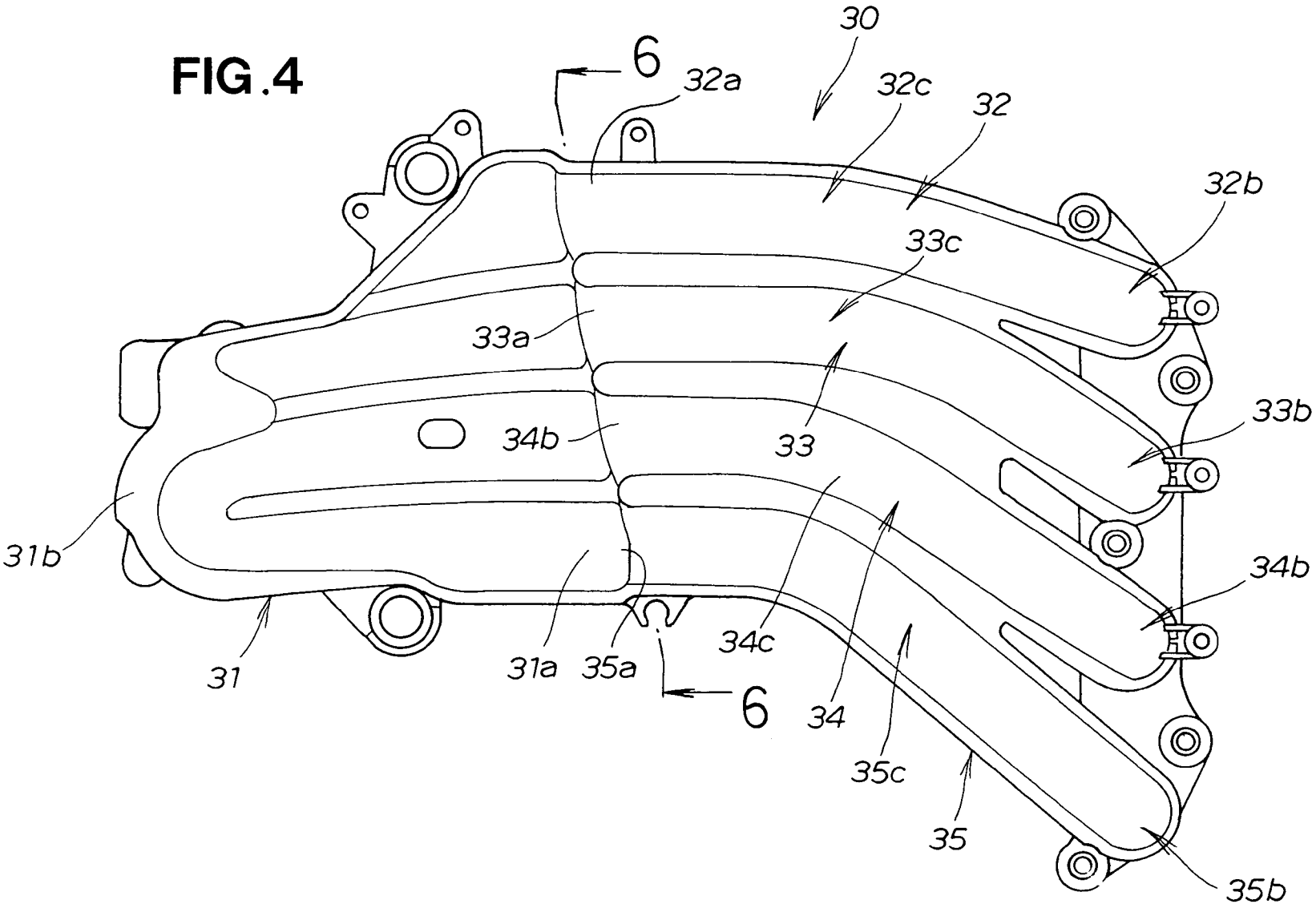
FIG. 4 is a further enlarged view of the intake manifold shown in FIG. 3.

The intake manifold 30 has an integral structure in which the outer member 30A and inner member 30B are joined together. The intake tubes 32, 33, 34, and 35 are separated at equal intervals in the vertical direction by separators 30*a*, 30*b*, and 30*c*, and have channels 36, 37, 38, and 39, respectively. The openings 36*a*, 37*a*, 38*a*, and 39*a* shown in the diagram are openings in the highest upstream area of the channels 36, 37, 38, and 39, and are in communication with the surge tank 31 shown in FIG. 4.

The cross-sectional shape of the channels 36, 37, 38, and 39 of the intake tubes 32, 33, 34, and 35 in the vertical dimension is smaller and flatter than in the crosswise dimension. In other words, the openings 36*a*, 37*a*, 38*a*, and 39*a* have a transversely extended elliptical shape.

The flat-shaped openings 36*a*, 37*a*, 38*a*, and 39*a* may be formed at least in upstream areas of the intake tubes 32, 33, 34, and 35, i.e., in the base end portions 32*a*, 33*a*, 34*a*, and 35*a* shown in FIG. 3. The cross-sectional channel from the intermediate portions 32*c*, 33*c*, 34*c*, and 35*c* of the intake tubes 32, 33, 34, and 35 to the downstream distal end portions 32*b*, 33*b*, 34*b*, and 35*b* may be flat, circular, or almost circular. In other words, the channel (opening) of the portion that branches from the surge tank 31 to the intake tubes 32 to 35 may be a flat, transversely extended elliptical shape. The openings 32*d*, 33*d*, 34*d*, and 35*d*, which are furthest downstream and constitute the ports connected to the combustion chambers 4*a* (FIG. 1), may alternatively be circular or almost circular, as shown in FIG. 5.

In this manner, the shape of the openings 36*a*, 37*a*, 38*a*, and 39*a* in the highest upstream area in communication with the surge tank 31 is a transversely extended and flat shape in the highest upstream area of the intake tubes 32 to 35 connected to the combustion chambers 4*a*. For this reason, the space between the openings 36*a*, 37*a*, 38*a*, and 39*a* of the highest upstream areas of the intake tubes 32, 33, 34, and 35, i.e., the space between the openings 36*a* and 37*a*, 37*a* and 38*a*, and 38*a* and 39*a*, is set to be larger by an amount commensurate with the extent to which the openings are made flat, as shown in FIG. 6. In other words, there is an increase the space between the openings 36*a*, 37*a*, 38*a*, and 39*a* of the intake tubes 32, 33, 34, and 35 adjacent in the vertical direction is increased, i.e., the space between adjacent openings. As a result, the intake flow of one of two adjacent openings is less likely to flow to the other opening. For this reason, intake interference between the openings 36*a*, 37*a*, 38*a*, and 39*a* of the adjacent intake tubes 32, 33, 34, and 35 is prevented, the intake pulses of the surge tank 31 can be effectively used, and improved output of the engine can be assured.

The cross-sectional shape of channels in the intake tubes 32, 33, 34, and 35 is a transverse flat shape in which the length in the vertical dimension is less than the length in the crosswise dimension. Therefore, the dimension in the height direction of the intake tubes and openings can be reduced, the effect of the dimension in the height of the intake tubes and intake manifold can be lessened, the outside dimensions of the outboard engine unit can be made more compact, and an efficient use of space inside the engine compartment can be assured.

Figure 7:
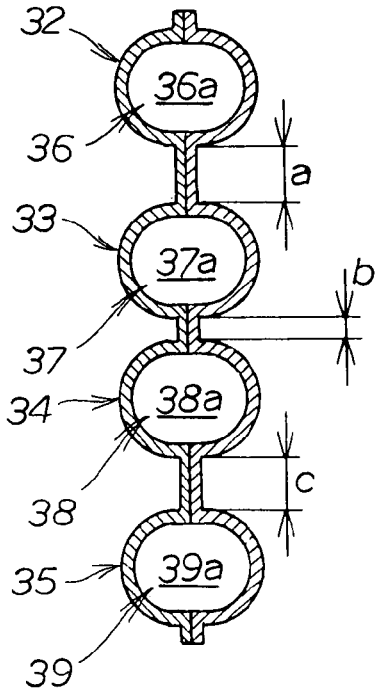
FIG. 7 is a cross-sectional view showing a modification of the intake manifold of FIG. 6.

FIG. 7 shows a modified example of the arrangement of the intake tubes 32, 33, 34, and 35 shown in FIG. 6. The embodiment shown in FIG. 6 is an example in which the spacing (separation distance) between the intake tubes 32, 33, 34, and 35 is kept constant (at equal intervals). The modified example in FIG. 7 shows a case in which the spacing is not uniform, however.

In reference to FIG. 7, the first interval a between the highest first intake tube 32 and the second intake tube 33 is the same space as that used in the embodiment shown in FIG. 6, the second interval b between the second intake tube 33 and the third intake tube 34 is less than the first interval a, and the third interval between the third intake tube 34 and the fourth intake tube 35 is set to be the same as the first interval a. Specifically, the configuration is designed so as to achieve a relationship in which a is equal to c, and a and c are greater than h.

In this manner, the spacing between the openings can be increased and intake interference can be prevented even if the opening 37*a* of the second intake tube 33 and the opening 38*a* of the third intake tube 34 are placed close to each other, as long as the ignition of the cylinders proceeds in the following sequence, for example: opening 36*a* of the first intake tube 32, opening 37*a* of the second intake tube 33, opening 39*a* of the fourth intake tube 35, and opening 38*a* of the third intake tube 34.

Therefore, in the modified example shown in FIG. 7, the height of the intake manifold can be further reduced in comparison with the embodiment shown in FIG. 6, the outboard engine unit can be made more compact, and an efficient use of space inside the engine compartment can be assured.

Figure 10:
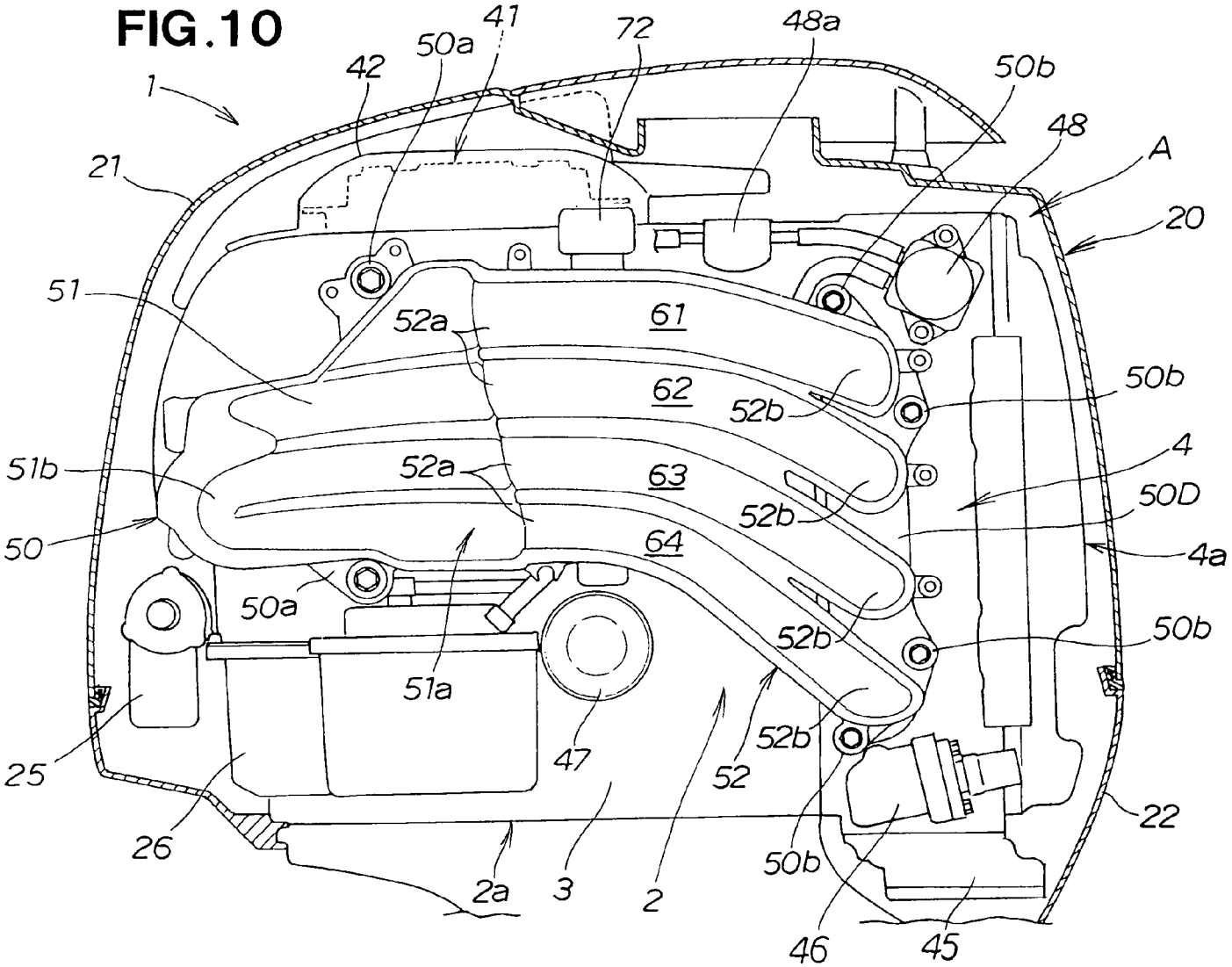
FIG. 10 is an enlarged view similar to FIG. 3 but showing an intake manifold according to a second embodiment of the present invention.

The outboard engine unit according to a second embodiment will be described next with reference to FIG. 10 and later diagrams. In FIG. 10 and later, the same reference numerals are used for the same members as the outboard engine unit according to the first embodiment, and a detailed description of the members is omitted.

Figure 11:
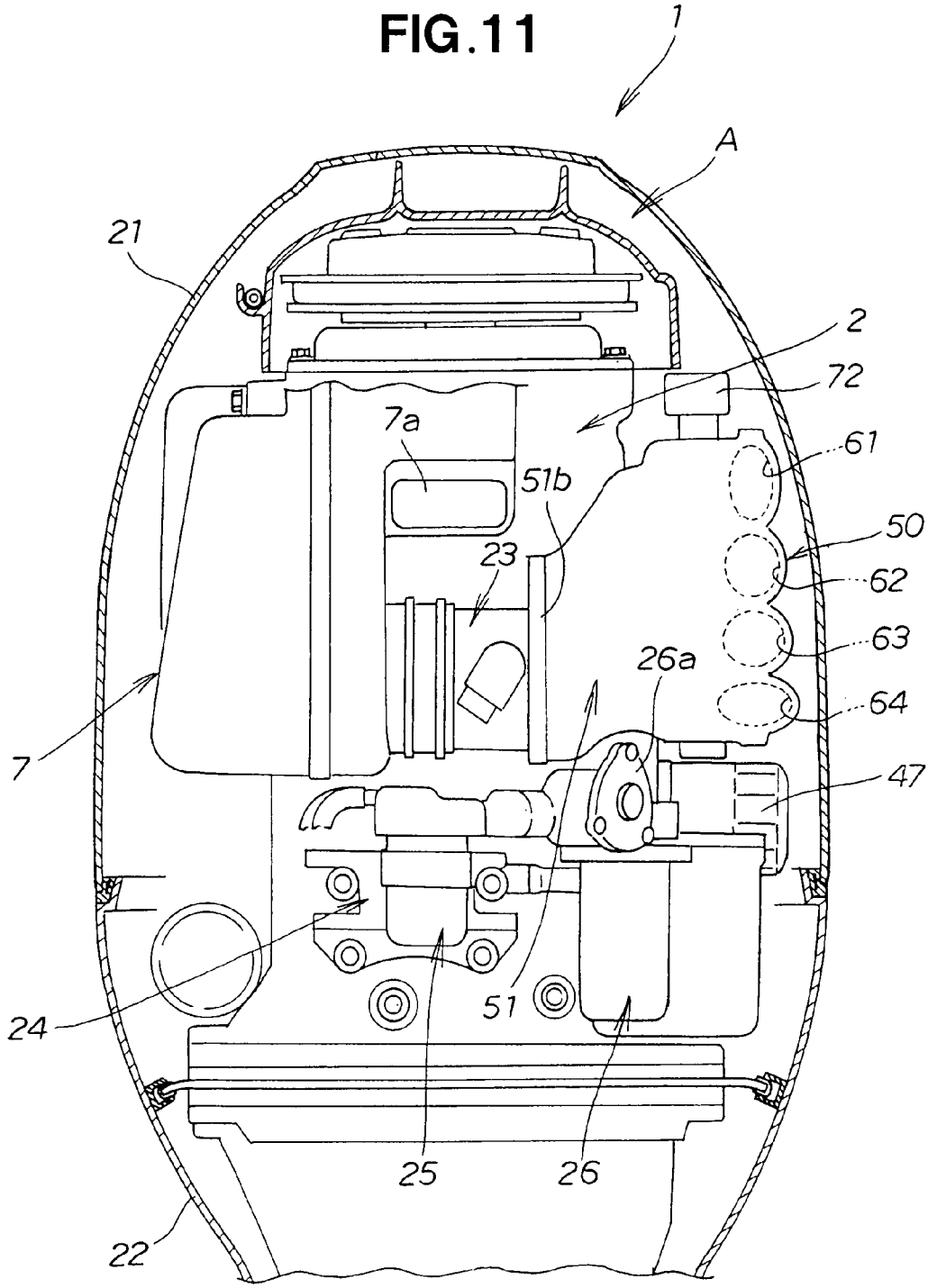
FIG. 11 is a front elevational view showing the outboard engine unit employing the second embodiment with the engine cover partially removed.
Figure 12:
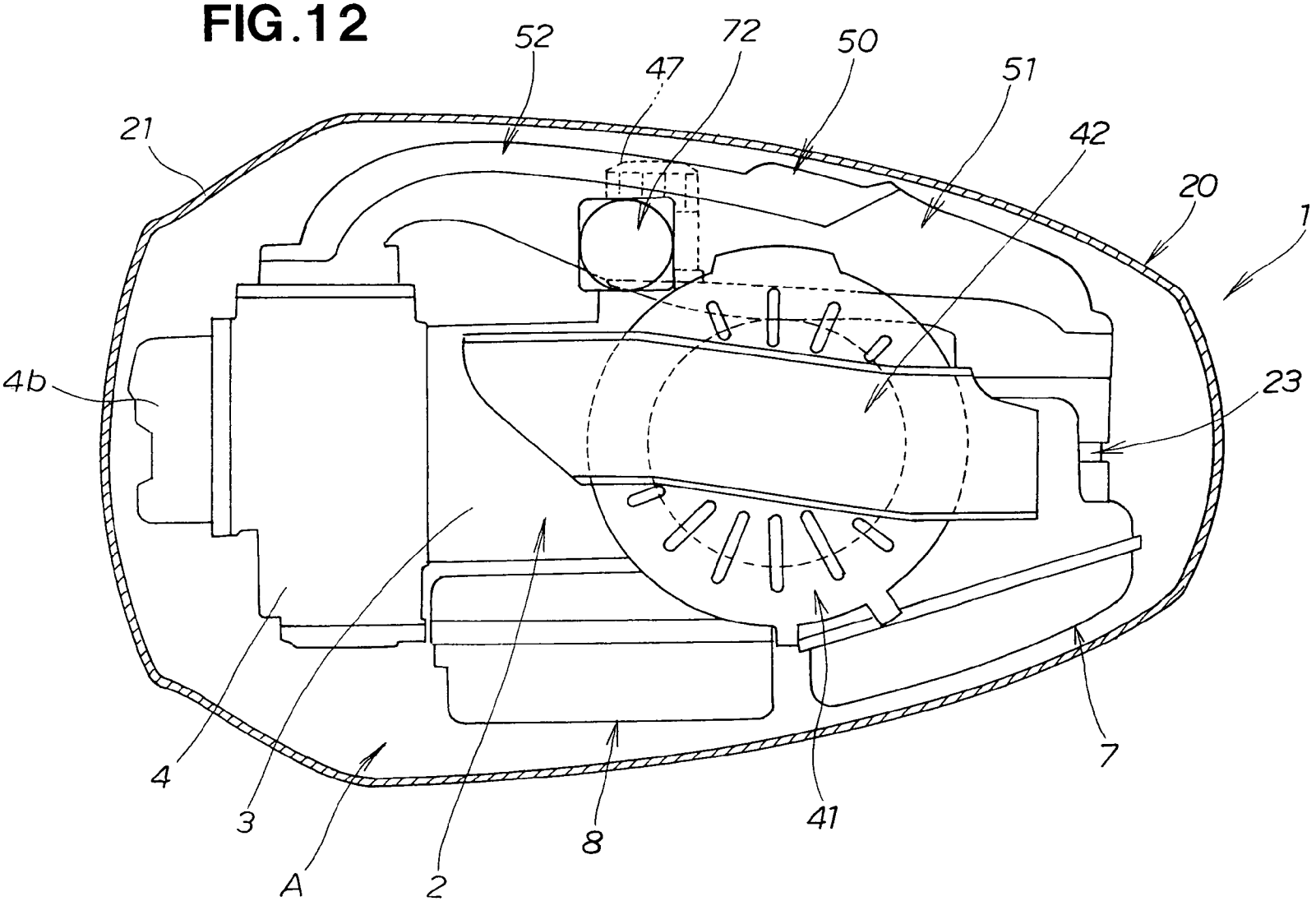
FIG. 12 is a top plan view showing the outboard engine unit employing the second embodiment with the upper cover partially removed.
Figure 13:
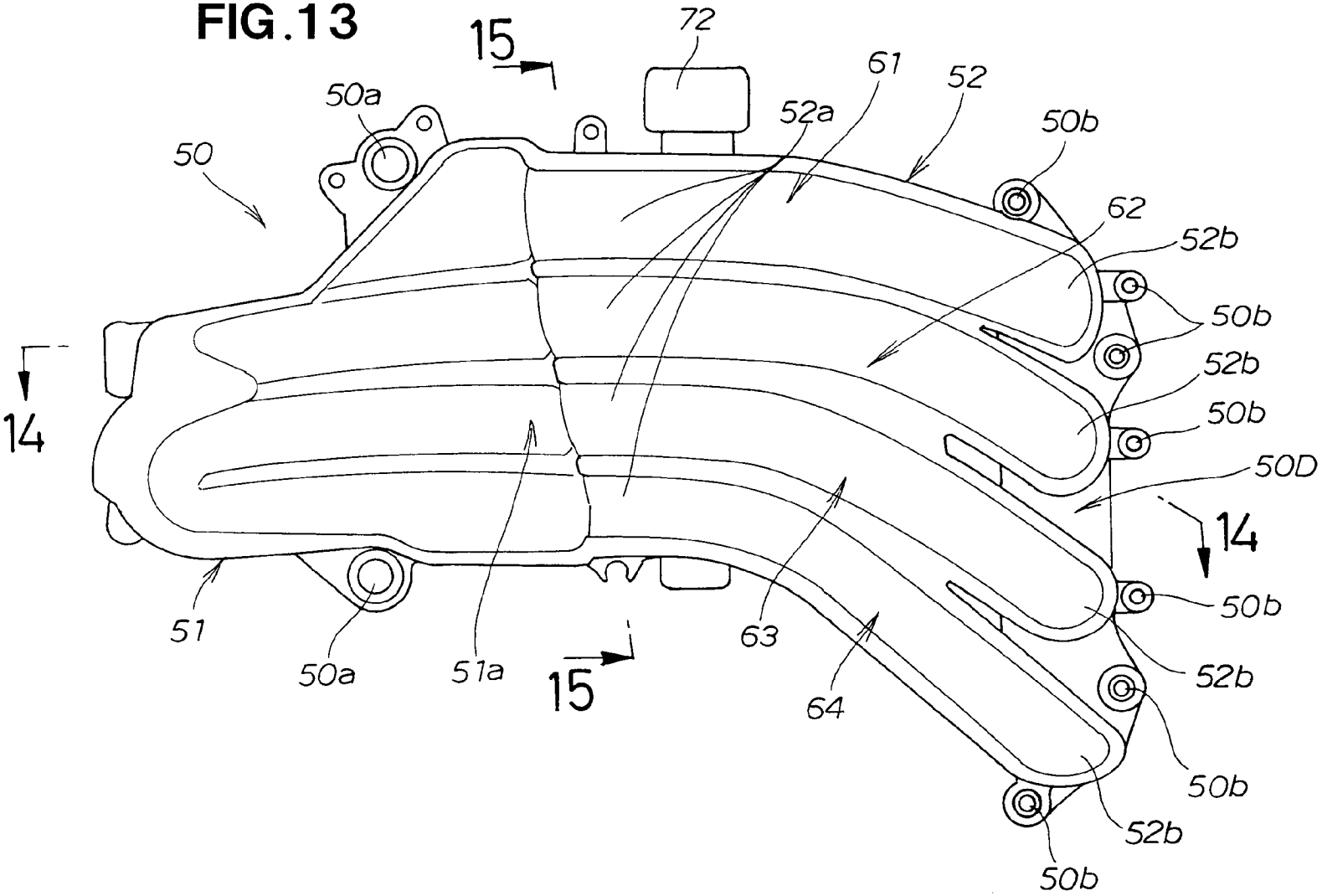
FIG. 13 is a view showing the intake manifold according to the second embodiment shown in FIG. 10.

The intake manifold 50 according to the second embodiment is disposed on the left side surface of the engine 2, as shown in FIGS. 10, 11; and 12. The intake manifold 50 is composed of a large-capacity surge tank 51 that faces the intake silencer 7 (FIG. 12), and an intake tube portion 52 connected so as to be in communication with the downstream portion of the surge tank 51.

In this embodiment, the intake tube portion 52 is composed of four intake tubes 61, 62, 63, and 64 because the engine 2 has four cylinders aligned in the vertical direction. The intake tubes 61 to 64 are in communication with the surge tank 51.

The four intake tubes 61, 62, 63, and 64 branch off from the downstream portion 5la of the surge tank 51, and are composed of base end portions 52*a* that are in communication with the surge tank 51. The furthest downstream portions 52*b* of the intake tube portion 52 are connected to the intake ports of the cylinder head 4 as the downstream end portions of the intake tubes 61 to 64, respectively.

The furthest upstream portion 51*b* of the surge tank 51 is in communication with the intake silencer 7 by way of the throttle valve device 23, as shown in FIG. 11.

Four intake ports of the surge tank 51 are disposed in the vertical direction, and the highest first intake tube 61, the lower second, third, and fourth intake tubes 62, 63, and 64 are therefore curved downward in sequence.

Mounts 50*a* and 50*a* for mounting the intake manifold 50 on the cylinder block 3 are disposed in an upstream area of the intake manifold 50, as shown in FIG. 10. A plurality of mounts 50*b* for mounting the intake manifold 50 on the cylinder head 4 is disposed in a downstream area of the intake manifold 50. The plurality of mounts 50*b* is disposed on a plurality of bridges 50D that connect to a downstream end portion of the intake tubes 61 to 64.

Figure 14:
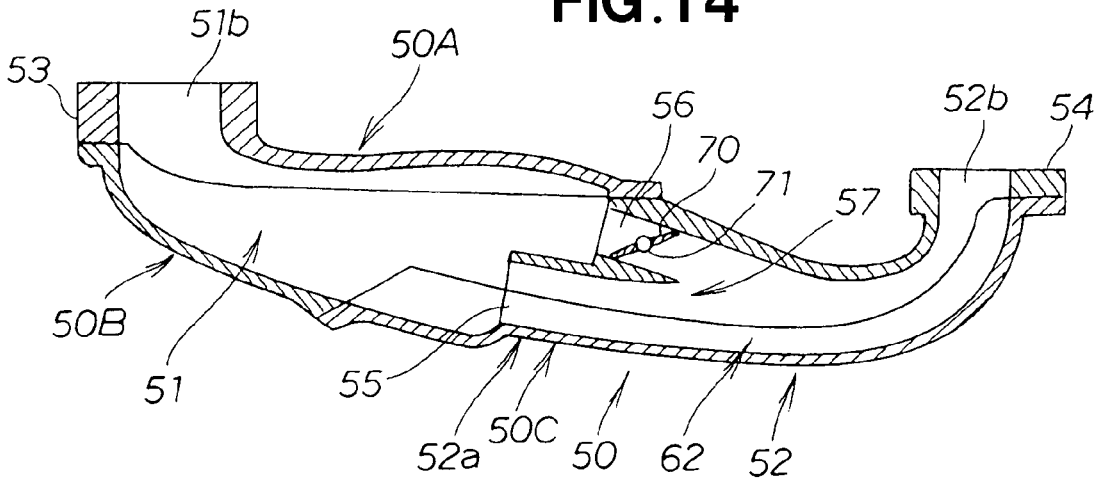
FIG. 14 is a cross-sectional view taken along line 14-14 of FIG. 13.

The intake manifold 50 has a structure in which three members, i.e., an inner member 50A, a front half outer member 50B, and a rear half outer member 50C that forms the outside of the intake tube portion 52, are superimposed with each other, as shown in FIG. 14. These three members 50A, 50B, and 50C are fabricated to form a single body as the intake manifold 50 by welding the mutually joining surfaces using vibration welding, for example.

Each of the intake tubes 61 to 64 is connected to the cylinder head 4 so as to be in communication with the intake port of the cylinder head 4. The upstream area of the intake tubes 61 to 64 in communication with the surge tank 51 have long channel portions 55 and short channel portions 56, as shown in FIG. 14. The long channel portions 55 are outwardly positioned inside the intake tubes 61 to 64, and the short channel portions 56 are positioned on the inner side (near the engine). The short channel portions 56 are positioned further downstream than the long channel portions 55. The long channel portions 55 and short channel portions 56 merge in shared channels 57 on the downstream side of the two channel portions.

An on-off valve 70 composed of a butterfly valve is disposed in each of the short channel portions 56. The on-off valves 70 are opened and closed by a shared operating shaft 71 that is rotatably driven by a diaphragm or another actuator 72 disposed on the intake manifold 50.

The on-off valve 70 shown in FIG. 14 is in a closed state. In other words, the short channel portions 56 of the intake tubes 61 to 64 are closed by the on-off valves 70, and the long channel portions 55 are open. As a result, only the long channel portions 55 of the intake tubes 61 to 64 are in communication with the intake ports of the cylinder head and form a low-speed, low-load operation area.

When the on-off valves 70 open from the closed state shown in FIG. 14, the short channel portions 56 are brought into communication with the shared channels 57, and the long channel portions 55 and short channel portions 56 of the intake tubes 61 to 64 are brought into communication with the intake ports of the cylinder head to form a high-speed, high-load operation area.

In this manner, in the intake tubes according to the second embodiment, the short channel portions of the intake tubes are opened and closed in accordance with the operating state of the engine, whereby the intake to the engine can be switched in two stages.

Figure 15:
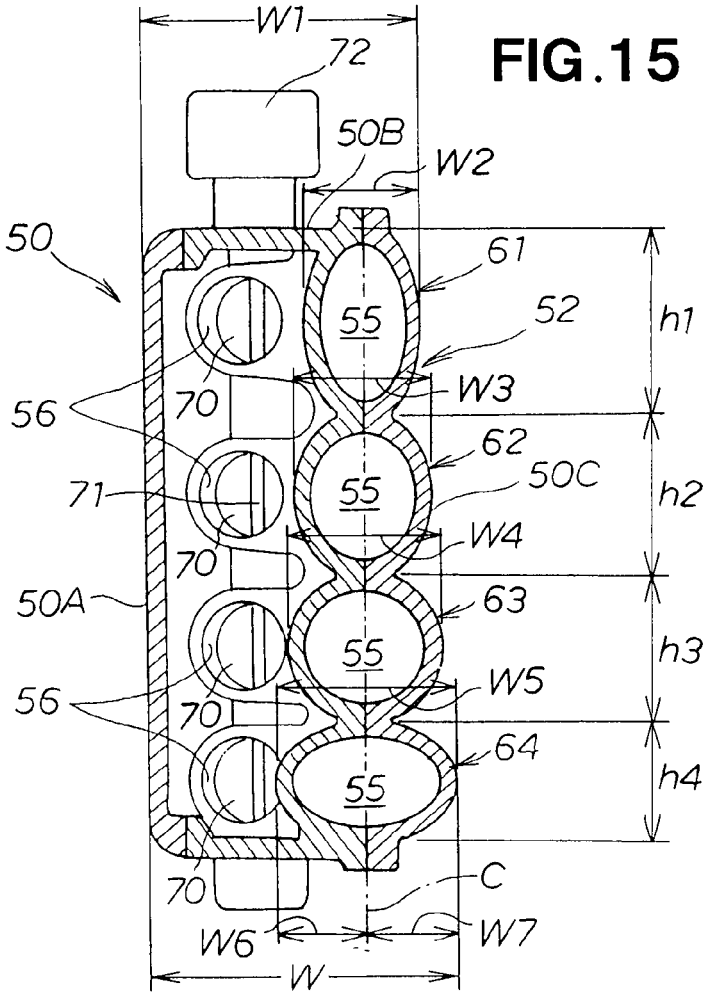
FIG. 15 is a cross-sectional view taken along line 15-15 of FIG. 13.

Reference is now made to FIG. 15 showing a cross-sectional shape of the vertically disposed intake tubes 61 to 64 in the intake tube portion 52 connected to the surge tank 51 of the intake manifold 50.

First, the cross-sectional shape of the highest first intake tube 61 is a longitudinally extended elliptical shape. The cross-sectional shape of the second intake tube 62 below the first intake tube is a little longer in the transverse direction than the cross-sectional shape of the first intake tube 61, and is a longitudinally extended elliptical shape in relative terms. The cross-sectional shape of the third intake tube 63 below the second intake tube 62 is roughly a circular shape that is yet a little transversely longer than the cross-sectional shape of the second intake tube 62. The cross-sectional shape of the lowest fourth intake tube 64 is a little longer in the transverse direction than the cross-sectional shape of the third intake tube 63 and has a transversely extended elliptical shape. The cross-sectional shapes of the four intake tubes 61 to 64 are thereby configured so that the highest first intake tube 61 is the longest in the longitudinal direction, and the lowest fourth intake tube 64 is the longest in the transverse direction in comparison with the other cross-sectional shapes. However, the cross-sectional areas of the intake tubes 61 to 64 are essentially equal.

The short channel portions 56 of the intake tubes 61 to 64 are also positioned in the vertical direction and have circular cross-sectional shapes.

Therefore, the width (thickness) of the intake manifold 50 is such that the width W1 of the highest first intake tube 61 is less than the width W of the lowest fourth intake tube 64. As a result, the lowest portion of the intake manifold 50 protrudes more greatly in comparison with the amount by which the highest portion protrudes from the side surface of the engine 2 (engine block 2*a*).

Specifically, when a first width W2 is the width of the first intake tube 61, a second width W3 as the width of the second intake tube 62 is set to be greater than the first width W2, a third width W4 as the width of the third intake tube 63 is set to be greater than the second width W3, and a fourth width W5 as the width of the fourth intake tube 64 is set to be greater than the third width W4. In other words, the widths of the intake tubes 61 to 64 have the following relationship: W2<W3<W4<W5.

The intake tubes 61 to 64, as indicated by W6=W7, have a bilateral symmetry with respect to the center line C, and W6+W7=W5.

When h is the dimension in the longitudinal direction of the intake tubes 61 to 64, the longitudinal dimension h2 of the second intake tube 62 is less than the longitudinal dimension h 1 of the first intake tube 61, the longitudinal dimension h3 of the third intake tube 63 is less than the longitudinal dimension h2 of the second intake tube 62, and the longitudinal dimension h4 of the fourth intake tube 64 is less than the longitudinal dimension h3 of the third intake tube 63. In other words, the dimensions h in the longitudinal direction of the intake tubes 61 to 64 have the following relationship: h1>h2>h3>h4.

Therefore, the height of the intake manifold 50 can be reduced in comparison with the case in which all of the intake tubes that are arranged in the vertical direction are set to be long in the longitudinal direction, and since the lowest intake tube is long in the transverse direction, the lowest intake tube protrudes more greatly from the side surface of the engine. As a result, the height of the intake manifold 50 is reduced.

Therefore, the upper portion is narrow and the cross section of the intake channels can be increased along the inner wall of the engine cover, which has a wide lower portion.

In the second embodiment described above, the cross-sectional shape of the highest of the intake tubes 61 to 64 is a longitudinally extended elliptical shape, the lowest tube has a transversely extended elliptical shape, and the dimension in the width direction increases in a sequential fashion from top to bottom.

Figure 16:
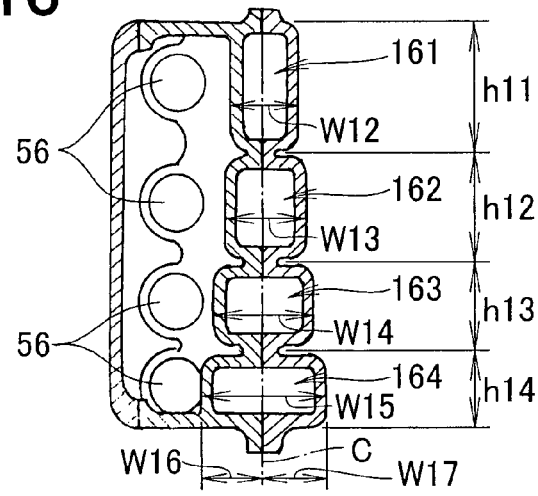
FIG. 16 is a cross-sectional view showing a first modification of an intake tubes according to a second embodiment shown in FIG. 15.
Figure 17:
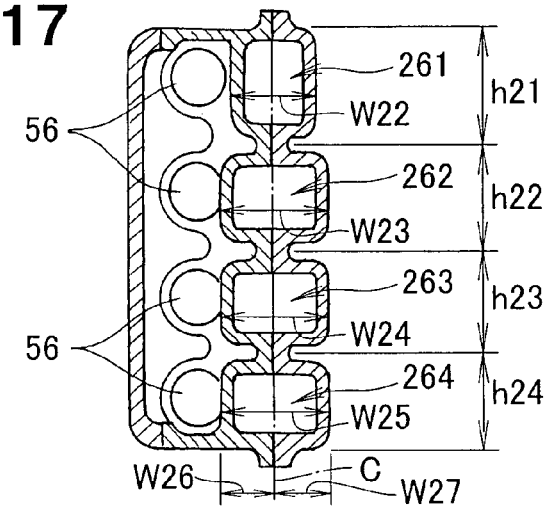
FIG. 17 is a cross-sectional view showing a second modification of the intake tubes according to the second embodiment shown in FIG. 15.
Figure 18:
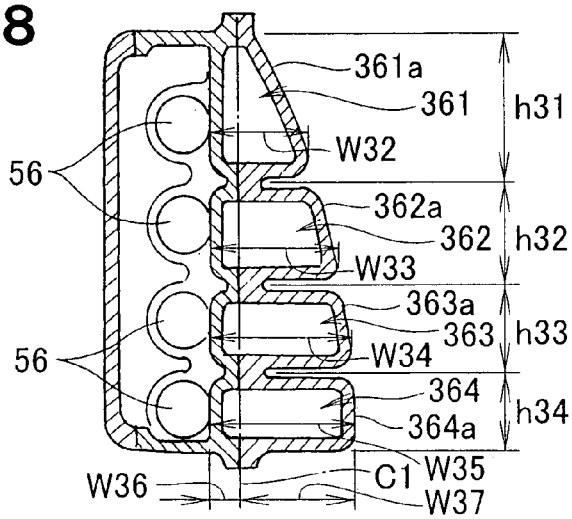
FIG. 18 is a cross-sectional view showing a third modification of the intake tubes according to the second embodiment shown in FIG. 15.

FIGS. 16, 17, and 18 show a modified example in which shapes other than elliptical shapes are used as the cross-sectional shapes of the intake tubes of the second embodiment.

The cross-sectional shapes of intake tubes 161, 162, 163, and 164 of the first modified example shown in FIG. 9 are rectangular. The cross-sectional shape of the highest first intake tube 161 is a longitudinally long rectangular shape. The cross-sectional shape of the second intake tube 162 is a longitudinally long rectangular shape in which the longitudinal dimension is less than that of the first intake tube 161 and the transverse dimension is greater. The cross-sectional shape of the third intake tube 163 is rectangular and slightly long in the transverse direction. The cross-sectional shape of the lowest fourth intake tube 164 is a transversely long rectangular shape in which the longitudinal dimension is less than that of the transversely long rectangular shape of the third intake tube 163 and the transverse dimension is greater.

Specifically, when the width W12 is set as the transverse dimension of the first intake tube 161 and h11 is defined to be the dimension in the height direction, the width W13 of the second intake tube 162 is greater than the width W12 of the first intake tube 161, and the height h12 is less than the height h11 of the first intake tube 161. The width W14 of the third intake tube 163 is greater than the width W13 of the second intake tube 162, and the longitudinal dimension h13 is less than the longitudinal dimension h12 of the second intake tube 162. The width W15 of the fourth intake tube 164 is greater than the width W14 of the third intake tube 163, and the longitudinal dimension h14 is less than the longitudinal dimension h13 of the third intake tube 163. Therefore, the cross-sectional shape of the highest first intake tube 161 is a tall, narrow, longitudinally long rectangular shape, and the width of the intake tubes gradually increases in progression downward and longitudinal dimension gradually decreases. In other words, the widths of the intake tubes 161 to 164 have the following relationship: W12<W13<W14<W15. The intake tubes 161 to 164 have a bilateral symmetry with respect to the center line C, as indicated by W16=W17. The longitudinal dimensions of the intake tubes 161 to 164 have the following relationship: h11>h12>h13>h14.

The cross-sectional areas of the intake tubes 161 to 164 of the first modified example are essentially equal.

The second modified example shown in FIG. 17 is one in which the cross-sectional shapes of the intake tubes 261, 262, 263, and 264 are rectangular, and shows an example in which the cross-sectional shape of the highest first intake tube 261 is a longitudinally long rectangle.

The cross-sectional shapes of the second to fourth intake tubes 262, 263, and 264 are transversely long shapes in which the dimensions in the transverse direction are greater than the dimensions in the longitudinal direction in terms of a height/width ratio. The second to fourth intake tubes 262, 263, and 264 have the same cross-sectional shape.

Specifically, the cross-sectional shape of the first intake tube 261 is a longitudinally long rectangle in which the W22 is the width and h21 is the dimension in the longitudinal direction of the first intake tube 261. The width W23 of the second intake tube 262 is greater than the width of the W22 of the first intake tube 261, and the longitudinal dimension h22 is less than the longitudinal dimension h21 of the first intake tube 261. The widths W24 and W25 of the third and fourth third intake tubes 263 and 264 are the same as the width W23 of the second intake tube 262, and the longitudinal dimensions h23 and h24 of the third and fourth third intake tubes 263 and 264 are the same as the longitudinal dimension h22 of the second intake tube 262. Therefore, in the second embodiment, the cross-sectional shapes of the second to fourth intake tubes 262, 263, and 264 are the same. In other words, the widths of the intake tubes 261 to 264 have the following relationship: W22<W23=W24=W25. The intake tubes 261 to 264 have a bilateral symmetry with respect to the center line C, as indicated by W26=W27. The longitudinal dimensions h of the intake tubes 261 to 264 have the following relationship: h21>h22=h23=>h24.

The cross-sectional areas of the intake tubes 261 to 264 of the second modified example are essentially equal.

The third modified example shown in FIG. 18 is one in which the cross-sectional shape of the highest first intake tube 361 is substantially right-triangular. Therefore, the first intake tube 361 has a longitudinally long shape which is narrow at the top and wide at the bottom.

A second intake tube 362 is long in the transverse direction, but the outer surface 362*a* is sloped so as to become wider in progression from the top to the bottom.

A third intake tube 363 is long in the transverse direction in the same manner as the second intake tube 362, but the outer surface 363*a* is sloped sharply to become wider in progression from the top to the bottom.

The cross-sectional shape of the lowest fourth intake tube 364 is a transversely long rectangle.

Specifically, W32 is the width of the first intake tube 361, which has a right-triangular cross-sectional shape, and h31 is the dimension in the longitudinal direction. The upper portion of the outer surface 361*a* is nearer to the engine side (leftward in the diagram), and the lower portion is a sloped surface that slopes away in the opposite direction (rightward in the diagram).

The maximum width W33 of the second intake tube 362 is greater than the width W32 of the first intake tube 361, and the longitudinal dimension h32 is less than the longitudinal dimension h31 of the first intake tube 361. The upper portion of the outer surface 362*a* of the second intake tube 362 is nearer to the engine side, and the lower portion slopes outward. The slope is greater than that of the outer surface 361*a* of the first intake tube 361.

The maximum width W34 of the third intake tube 363 is greater than the maximum width W33 of the second intake tube 362, and the longitudinal dimension h33 is less than the longitudinal dimension h32 of the second intake tube 362. The upper portion of the outer surface 363*a* of the third intake tube 363 is nearer to the engine side in the same manner as the first and second intake tubes 361 and 362, and the lower portion slopes outward. The slope is greater than that of the outer surface 362*a* of the second intake tube 362.

The maximum width W35 of the fourth intake tube 364 is greater than the maximum width W34 of the third intake tube 363, and the longitudinal dimension h34 is slightly less than the longitudinal dimension h33 of the third intake tube 363. The outer side surface of the 364*a* of the fourth intake tube 364 is perpendicular, and the cross-sectional shape is a transversely long rectangle.

The maximum widths W of the intake tubes 361 to 364 have the following relationship: W32<W33<W34<W35. The longitudinal dimensions h of the intake tubes 361 to 364 have the following relationship: h31>h32>h33>h34. The intake tubes 361 to 364 are arranged so that the lengths W36 and W37 in the transverse direction to the left and right have a bilateral symmetry with respect to the joining line C1 in the perpendicular direction of the left and right members 50C and 50B shown in FIG. 14.

The cross-sectional areas of the intake tubes 361 to 364 of the third modified example are essentially equal.

The cross-sectional shapes of the intake tubes 361 to 364 according to a third embodiment shown in FIG. 18 are designed so that the surfaces on the engine side are uniformly perpendicular as shown in the diagrams, and the upper portion of the outer surfaces 361*a* to 363*a* is narrow and the lower portion is wide, as described above. In other words, the intake tubes 361 to 364 arranged in the vertical direction slope so as to protrude outward from the higher positions to the lower positions, and the intake tubes 361 to 364 are designed to have the same cross-sectional areas. Therefore, the width direction of the highest first intake tube 361 can be effectively reduced.

The width direction of the lowest fourth intake tube 364 is increased, as is the dimension in the longitudinal direction of the intake manifold. Therefore, the intake manifold can be made to effectively follow the inner wall of the engine cover in which the upper portion is narrow and the lower portion is wide.

Figure 19:
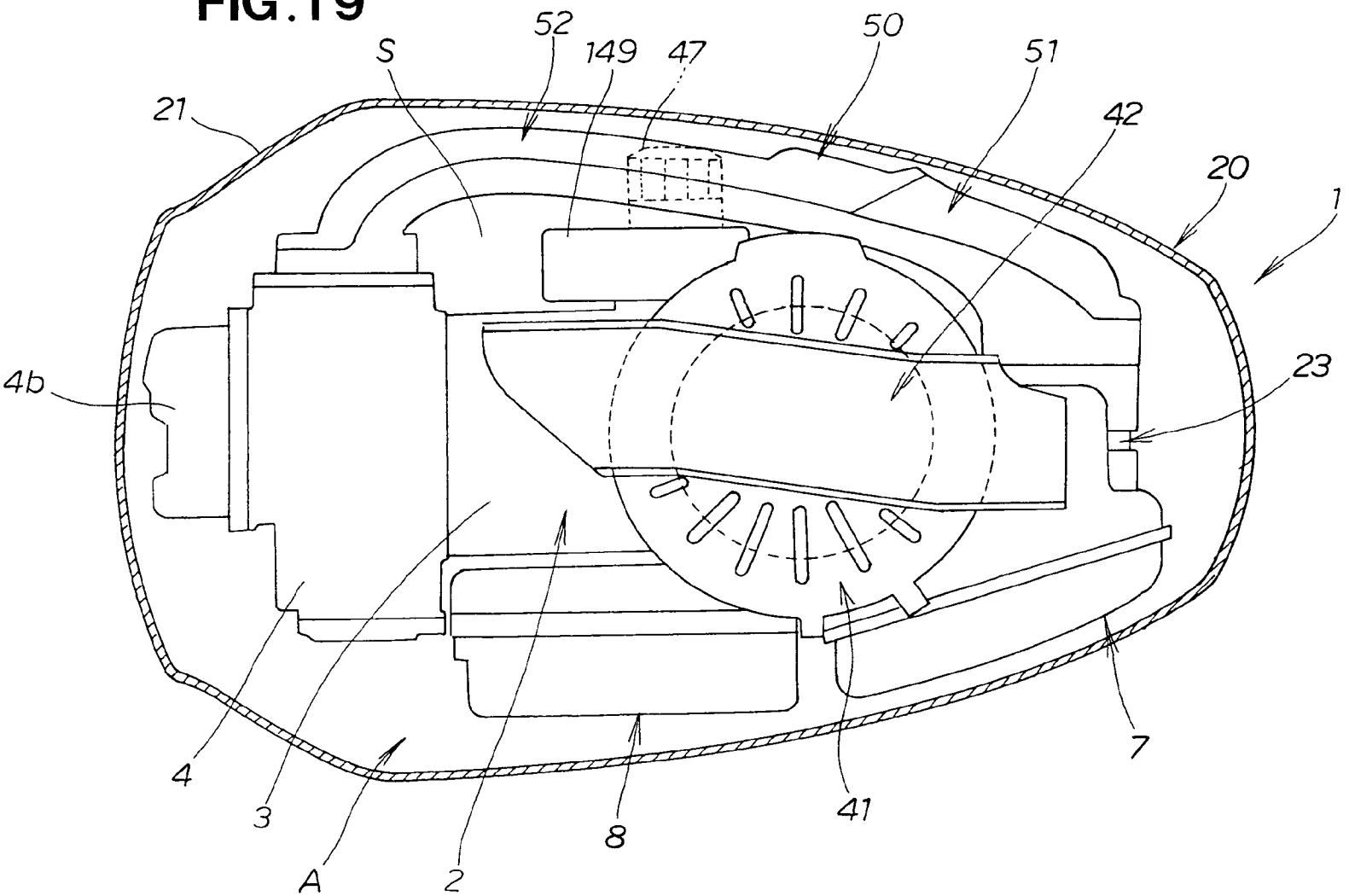
FIG. 19 is a top plan view showing the outboard engine unit with the upper cover partially removed, in which a space is assured between an engine block and the air tubes.

In the intake tubes according to the second embodiment, the upstream portions of the intake valves were described to have a structure in which the outwardly disposed long channel portions and the inwardly disposed short channel portions are disposed in parallel, but the present invention is not limited to this configuration, and the inwardly disposed short channel portions may be omitted, as shown in FIG. 19.

In the embodiment shown in FIG. 19, it is possible to adopt an arrangement in which short channel portions are not disposed in the intake tubes, and electrical components, a starter motor, a sub-fuel tank, and other auxiliary components are disposed in the space S between the surface of the inner side of the intake tubes (intake manifold) and the engine block surface. The present embodiment is an example in which a sub-fuel tank 149 is provided.

In this manner, space can be secured between the intake tubes and the engine block, and an intake device having a sufficient channel cross-sectional area can be obtained by configuring the shapes of the intake tubes in the manner of the example shown in FIG. 19.

Obviously, various minor changes and modifications of the present invention are possible in light of the above teaching. It is therefore to be understood that within the scope of the appended claims the invention may be practiced otherwise than as specifically described.

What is claimed is:

1. An outboard engine unit comprising:

an engine including an engine block, the engine block being comprised of a cylinder block, a cylinder head disposed in a rear portion of the cylinder block, and a crankcase disposed in a front portion of the cylinder block;

an engine cover defining an engine compartment for accommodating the engine; and an intake manifold comprised of a single surge tank and a plurality of intake tubes communicating with the surge tank, wherein the intake manifold extends in a front-and-rear direction along one side of the engine block, each of the intake tubes is arrayed so as to have a space between each other in a vertical direction, and the shape of a channel cross section of each of the intake tubes is a flat shape having a vertical dimension which is less than a dimension in a crosswise direction.

2. An outboard engine unit comprising:

an engine comprised of a cylinder block, a cylinder head disposed in a rear portion of the cylinder block, and a crankcase disposed in a front portion of the cylinder block;

an engine cover defining an engine compartment for accommodating the engine; and an intake manifold comprised of a surge tank and a plurality of intake tubes having upstream portions being in communication with the surge tank, wherein the intake tubes are arrayed in a vertical direction and have downstream portions being in communication with combustion chambers formed in such a manner as to be aligned in a vertical direction in the cylinder head, each of the intake tubes has substantially a same cross-sectional area, and the cross-sectional shape of a channel in a highest one of the intake tubes is long in a longitudinal direction, and the cross-sectional shape of a channel in a lowest one of the intake tubes is long in a transverse direction.

3. The outboard engine unit of claim 2, wherein each of the intake tubes is provided with an outer long channel portion and a short channel portion near the engine that are arranged in parallel inside the engine compartment, the channel portions merge in a shared channel on a downstream side, the cross-sectional shape of the highest long channel portion selected from the long channel portions is long in the longitudinal direction, and the lowest long channel portion has a cross-sectional shape long in the transverse direction, and each of the short channel portions is provided with an on/off valve that operates simultaneously in a same direction.

4. The outboard engine unit of claim 2, wherein the cross-sectional shape of channels in the intake tubes is one in which the highest long channel portion and a shared channel in communication therewith are long in the longitudinal direction, and the lowest long channel portion and the shared channel in communication therewith are long in the transverse direction, and the short channel portions have essentially the same cross-sectional shape.

* * * * *